United States Patent [19]

Aoki

[11] 4,429,606

[45] Feb. 7, 1984

[54] ELECTRONIC MUSICAL INSTRUMENT PROVIDING AUTOMATIC ENSEMBLE PERFORMANCE

[75] Inventor: Eiichiro Aoki, Hamamatsu, Japan

[73] Assignee: Nippon Gakki Seizo Kabushiki Kaisha, Hamamatsu, Japan

[21] Appl. No.: 390,952

[22] Filed: Jun. 22, 1982

[30] Foreign Application Priority Data

Jun. 30, 1981 [JP] Japan ..... 56-100459

[51] Int. Cl.[3] ..... G10H 1/02; G10H 1/38

[52] U.S. Cl. ..... 84/1.17; 84/1.24; 84/DIG. 4; 84/DIG. 22

[58] Field of Search ..... 84/1.17, 1.24, DIG. 4, 84/DIG. 22

[56] References Cited

U.S. PATENT DOCUMENTS 3,884,108 5/1975 Deutsch ..... 84/1.24
4,112,803 9/1978 Deutsch ..... 84/1.24
4,205,580 6/1980 Deutsch ..... 84/1.24
4,294,155 10/1981 Turner ..... 84/1.17 X
4,311,076 1/1982 Rucktenwald et al. ..... 84/1.17 X
4,342,248 8/1982 Deutsch et al. ..... 84/1.24

*Primary Examiner*—S. J. Witkowski
*Attorney, Agent, or Firm*—Spensley, Horn, Jubas & Lubitz

[57] ABSTRACT

A duet interval data memory includes tables each of which corresponds to a particular chord type and prestores a plurality of duet interval data. One of the tables is selected in accordance with the type of a chord being played in a lower keyboard. A note interval between a root note of this chord and a melody note being played in an upper keyboard constitutes a relative note. The duet interval data is read from the selected table in response to this relative note. A calculator alters the melody note by a note interval corresponding to the read out duet interval data thereby producing data representative of a duet note. The tone of this duet note is sounded with the tone of the melody note whereby an automatic ensemble performance is realized.

4 Claims, 8 Drawing Figures

ELECTRONIC MUSICAL INSTRUMENT PROVIDING AUTOMATIC ENSEMBLE PERFORMANCE

BACKGROUND OF THE INVENTION

This invention relates to an electronic musical instrument capable of automatically conducting ensemble performance such as duet performance.

An electronic musical instrument in which an ensemble note or notes such as a duet note (duet tone) is automatically added to a melody note played in the keyboard is disclosed in the specification of U.S. patent application Ser. No. 220,099 filed on Dec. 24, 1980, and now abandoned and corresponding European Patent Application Preliminary Publication No. 0031598. In these prior applications, the key (scale tonality) of the musical piece to be played is previously designated by musical key (scale tonality) designation means and the tone pitch (or note interval) of a duet note to be added to a melody note is selected in accordance with the designated key and an accompaniment chord. Further, in this prior art electronic musical instrument, judgements are made with respect to modulation, passing notes, cadence and other factors by confirming the progression of the music (i.e., progression of melody and accompaniment chords) and a duet note is added to the melody note strictly following the musical theory. The method of adding a duet note according to this prior application, however, requires a player to previously designate the key (scale tonality) of the music to be played before starting the music, and further the addition of a duet note in a musically advanced manner in accordance with the progression of the melody may be liable to cause an unexpected change in the progression of the duet performance in the event that the player commits mistake in manipulating keys. Thus the musical instrument may be difficult for beginners.

SUMMARY OF THE INVENTION

It is, therefore, an object of the invention to provide an electronic musical instrument by which beginners can enjoy ensemble performance, though the ensemble performance may not necessarily follow the musical theory very exactly. This object can be achieved by selecting, on the basis of a melody note and an accompaniment chord played in the keyboard, an ensemble note for this melody note in accordance with the relation between the chord and the melody note. Since, according to the invention, the necessity for designating the key of a music piece to be played is obviated and mistakes in manipulation of keys in the keyboard do not affect the progression of the automatic ensemble performance owing to obviation of the addition of an ensemble note in a musically advanced manner in accordance with the progression of the melody, even a beginner can readily enjoy the ensemble performance. Although the key of the music piece and the progression of the melody are disregarded in the present invention, still an adequate ensemble performance effect, even if it may not be highly advanced according to the musical theory, can be expected by paying regard to the accompaniment chords.

According to the invention, ensemble note tables are prepared corresponding to various chords, and one of the ensemble note tables is selected in accordance with each accompaniment chord played on the keyboard, and then from the selected table ensemble note generation data is read out as determined in accordance with the melody note played in the keyboard. And thus an ensemble tone signal is produced on the basis of this ensemble note generation data. The ensemble note tables are made by taking into consideration the following two points:

Firstly, the ensemble note should be selected from among the chord constituting notes. Since the notes constituting an accompaniment chord are mostly diatonic scale notes in the key of the music being played, no unnatural impression will be given if a note which is one of the chord constituting notes and has a certain note interval relation to the melody note is sounded with the melody note. Therefore, an ensemble performance which does not give an unnatural impression can be realized. For example, chords of C major, F major, G major, G seventh, A minor, D minor and E minor are frequently used for the musical pieces in key of C major and the chord constituting notes are limited to notes C, D, E, F, G, A and B, i.e., diatonic scale notes in key of C major. Accordingly, if one of the chord constituting notes is selected as the ensemble note, one of the diatonic scale note constitutes the ensemble note.

Secondly, the ensemble note should be selected from among notes which give the audience an ending sensation. According to the theory of cadence, the chords generally progress from $V_7$ (dominant seventh chord) to I (tonic triad) at the end part of the music and in this connection the melody moves from IV-note (fourth degree note) in correspondence to $V_7$-chcrd to III-note (third degree note) in correspondence to I-chord, or from VII-note (seventh degree note) in correspondence to $V_7$-chord to I-note (first degree note) in correspondence to I-chord. It is not possible in the present invention to apply the theory of cadence accurately, because the key of the music piece is not designated or the progression of the melody is not examined. It is however possible to apply the theory of cadence analogously by conveniently assuming an accompaniment chord being played as $V_7$-chord (dominant seventh chord) without judging the key of the musical piece being now performed if only the type of the accompaniment chord is seventh chord, and similarly by conveniently assuming an accompaniment chord as I-chord (tonic triad) without judging the key of the musical piece being now performed if only the type of the chord is major chord. Namely, when a seventh chord is being played, its root note is assumed to be the fifth degree note in the scale and when a major chord is being played, its root note is assumed to be the first degree note in the scale. The degrees in the scale of the melody note and the ensemble note are thus determined and then the theory of cadence is analogously applied. According to the theory of cadence, when the accompaniment chords progress from $V_7$ to I and the melody note progress from IV-note to III-note, the ensemble notes should preferably progress from VII-note to I-note. Likewise, when the accompaniment chords progress from $V_7$ to I and the melody notes progress from VII-note to I-note, the ensemble notes should preferably progress from IV-note to III-note. In such progressions of the melody notes and the ensemble notes, the degrees in the scale of the melody notes and the ensemble notes are determined analogously in accordance with the root notes of the accompaniment chords in the way mentioned above. It should be noted that the theory of cadence is not applied upon detection of the progression of the accompaniment chords and the melody but that the selection of ensemble notes is made in such a manner that the seventh degree note is selected unconditionally as the ensemble note when the accompaniment chord is $V_7$ and the melody note is the fourth degree note, and the first degree note is selected unconditionally as the ensemble note when the chord is I and the melody note is the third degree note. Likewise, when the chord is $V_7$ and the melody note is the seventh degree note, the fourth degree note is selected unconditionally as the ensemble note whereas when the chord is I and the melody note is the first degree note, the third degree note is selected unconditionally as the ensemble note. By such arrangement, the theory of cadence can be applied analogously on the basis of the present (now-being-played) accompaniment chord and the present melody note without considering the key of the music and the progression of the melody whereby notes giving the ending sensation can be selected as the ensemble notes.

The ensemble note tables made on the basis of the above described two factors need not be provided in the same number as the number of all individual chords but in the number of chord types (i.e., major, minor, seventh, etc.). In this case, a single ensemble note table is selected in accordance with the chord type and then the ensemble note generation data is read out from the selected ensemble note table in accordance with a note interval between the root note of the chord and the melody note. By way of example, the ensemble note generation data is formulated as data representing a note interval of the ensemble note relative to the melody note and a key code representing the tone pitch (or note name) of the ensemble note is obtained by adding or subtracting this ensemble note generation data to or from the key code of the melody note.

BRIEF DESCRIPTION OF THE DRAWINGS

In the accompanying drawings.

DESCRIPTION OF PREFERRED EMBODIMENT

Figure 1:
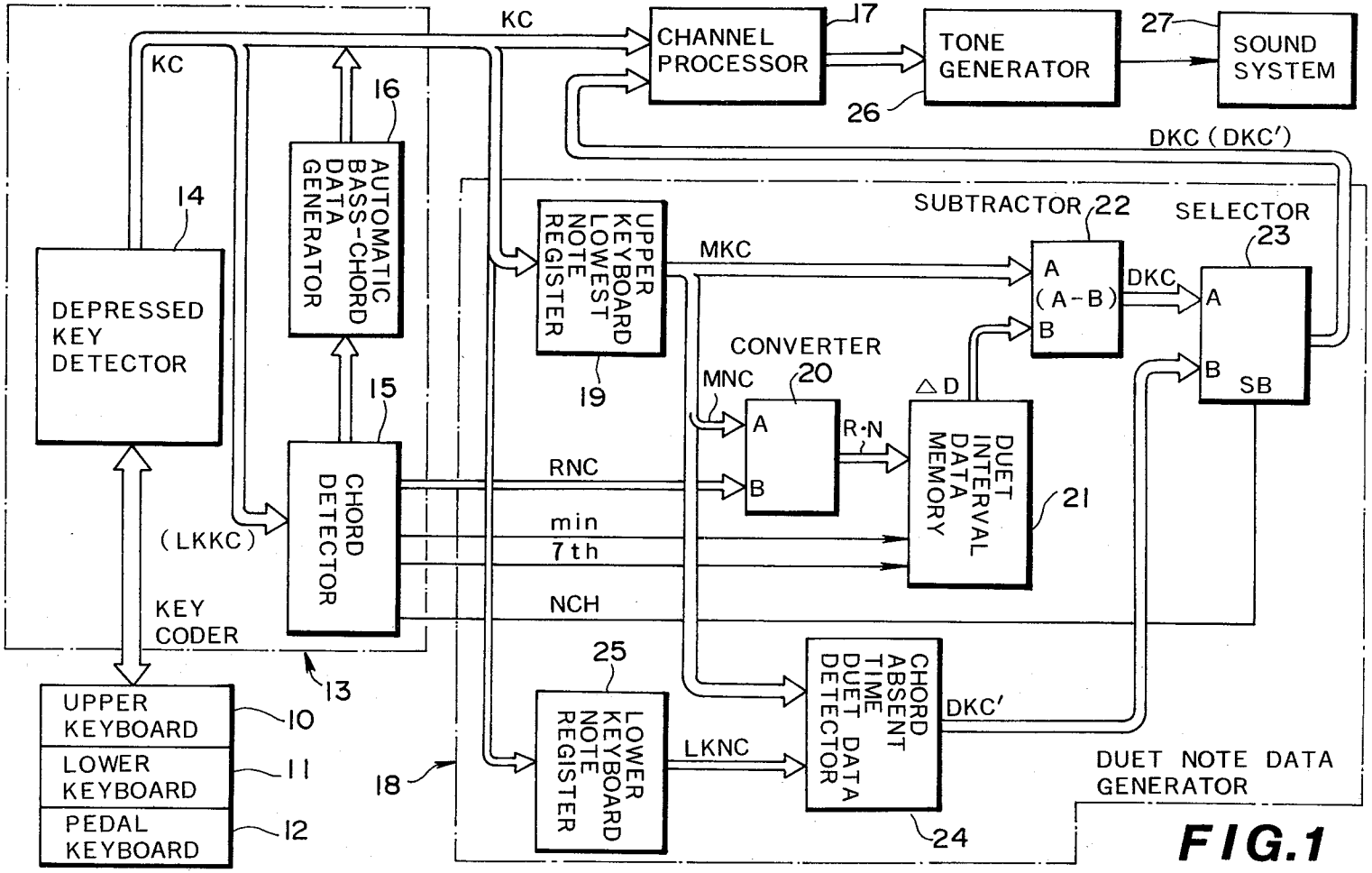
FIG. 1 is a block diagram showing an embodiment of the electronic musical instrument made according to the invention.

Referring to FIG. 1, an upper keyboard 10 is provided for playing melodies. An ensemble tones for the melody tones, duet tones are added to the tones of depressed keys in the upper keyboard 10 (i.e., melody tones). A lower keyboard 11 and a pedal keyboard 12 are accompaniment keyboards for playing accompaniment chords and bass tones. A key coder 13 has functions to detect depressed keys in the keyboards 10–12, to detect a chord on the basis of the depressed keys in the lower keyboard and to produce data for automatic bass tones and automatic chord tones on the basis of the detected chord. The key coder having such functions is known, e.g., in the specifications of Japanese Patent Preliminary Publication No. 54-98231 and U.S. Pat. No. 4,235,142 and the key coder 13 can be constructed readily on the basis of the disclosures of these specifications. Briefly explained, the key coder 13 includes a depressed key detector 14 which detects depressed keys in the keyboards 10–12 and outputs data representing the depressed keys (key codes) together with data representing the keyboards. A chord detector 15 receives key codes LKKC representing depressed keys in the lower keyboard 11 and detects an accompaniment chord on the basis of the key codes. As is well known in the art, a chord is detected from a combination of keys which are actually depressed in the lower keyboard under a fingered chord mode in the automatic bass/-chord performance whereas under a single finger mode a root note is detected from the depressed key itself in the lower keyboard 11 and a chord type is detected from a state of key depression in the pedal keyboard 12.

The chord detector 15 outputs a root note code RNC representing the root note of the detected chord, data signals min and 7th, and a chord absence signal NCH representing that a chord has not been detected. When the chord type is a major chord, the data signals min and 7th are both "0". When the chord type is a minor chord, the minor chord data signal min is "1". When the chord type is a seventh chord, the seventh chord data signal 7th is "1". The chord absence signal NCH is "0" when a chord has been detected and "1" when a chord has not been detected. An automatic bass/chord data generator 16 produces, upon selection of the automatic bass/chord performance by the player, key codes for the automatic bass tones and the automatic chord tones on the basis of the chord data (RNC, min, 7th, etc.) having been detected by the chord detector 15 and on the basis of an automatic performance pattern provided by a rhythm pattern generator (not shown).

The key codes of the depressed keys produced by the depressed key detector 14 and the key codes of the respective automatic tones produced by the automatic bass/chord data generator 16 are outputted on a time shared basis from the key coder 13 and supplied to a channel processor 17 and a duet note data generator 18. When the automatic bass/chord performance is not selected, key codes of the depressed keys in the keyboards 10–12 constitute, as they are, output key codes KC of the key coder 13. When the fingered chord mode of the automatic bass/chord performance has been selected, the key codes for the automatic bass tones produced by the automatic bass/chord data generator 16 are outputted as the key codes for the pedal keyboard among the key codes KC. When the single finger mode has been selected, the key codes for the automatic chord tones and the automatic bass tones produced by the automatic bass/chord data generator 16 are outputted as the lower keyboard key codes and the pedal keyboard key codes among the key codes KC.

In a duet note data generator 18, an upper keyboard lowest note register 19 memorizes a key code for the lowest note in the concurrently depressed keys in the upper keyboard 10 at every instant. Melody is usually played by a monotone performance. In a case where two or more upper keyboard keys are simultaneously depressed at a time for melody performance, a duet note is added to the lowest note in the depressed keys. It is for this purpose that the register 19 memorizes at every instant the key code for the lowest note among the upper keyboard depressed keys. When only a single key is being depressed in the upper keyboard 10, the key code for this key is stored in the register 19. The key code MKC stored in this manner is the register 19 represents a key code for a melody note to which a duet note is to be added.

In the duet note data generator 18, a duet key code DKC is formed on the basis of the melody note key code MKC stored in the register 19 and the root note code RNC and the chord type data min and 7th provided by the chord type detector 15. A converter 20 is a circuit provided for calculating a note interval between the melody note and the root note in the form of the number of semitones. Data representing the number of semitones thus calculated is hereinafter referred to as relative note data R·N of a melody note. The converter 20 receives, at its A input, the portion of the note code MNC representing the note in the melody key code MKC and, at its B input, the root note code RNC. The converter 20 performs subtraction "A−B", i.e., "MNC−RNC" to obtain the note interval of the melody note with respect to the root note in the form of the number of semitones. The relative note data R·N thus outputted from the converter 20 represents the interval in the number of semitones of the melody note with respect to the root note of the accompaniment chord. For the convenience of explanation, it is assumed that the key code consists of a duodecimal number in which the first digit is a note code representing a note and the second digit is an octave code representing an octave. In this case, the minimum unit "1" of the duodecimal number corresponds to a semitone. Accordingly, by calculating "MNC−RNC" by the duodecimal calculation conducted by the converter 20, the relative note data R·N representing the number of semitones can be obtained as difference of the subtraction "MNC−RNC". If the subtraction "MNC−RNC" is simply made, there will arise inconvenience that a negative value is outputted when RNC is larger than MNC. Accordingly, in the actual calculation, one octave code is added to the adjacent more significant digit of the note code MNC of the melody note in the duodecimal subtraction and bits for the note code only excluding the octave code are outputted as the output data R·N. The converter 20 may be constructed not only of a subtractor but also of a suitable table.

A duet interval data memory 21 comprises duet interval data tables corresponding respectively to chord types. A single table is selected depending upon the chord type data min or 7th and duet interval data ΔD is read from the selected table in accordance with the relative note data R·N. The duet interval data ΔD is data indicating in the number of semitones note interval (interval from the melody note) of the duet note to be added to the melody note represented by the key code MKC. An example of the duet interval data table corresponding to the respective chord types is shown in the following Table 1:

| | Relative note data R·N | | | | | | | | | | | |
|---|---|---|---|---|---|---|---|---|---|---|---|---|
| | 0 | 1 | 2 | 3 | 4 | 5 | 6 | 7 | 8 | 9 | 10 | 11 |
| Major chord | 8 | 9 | 7 | 8 | 4 | 5 | 6 | 3 | 4 | 5 | 6 | 7 |
| Minor chord | 9 | 6 | 7 | 3 | 4 | 5 | 6 | 4 | 5 | 6 | 7 | 8 |
| Seventh chord | 8 | 9 | 4 | 5 | 6 | 7 | 8 | 9 | 8 | 9 | 6 | 7 |

The duet interval data ΔD read from the memory 21 is supplied to the B input of the subtractor 22. The subtractor 22 receives at its A input the key code MKC of the melody note stored in the register 19 and the subtraction "A−B", i.e., "MKC−ΔD", is implemented by the duodecimal calculation.

As a result, the subtractor 22 outputs a key code DKC representing a note which is lower than the melody note by the number of semitones of the duet interval data ΔD. This output key code DKC of the subtractor 22 constitutes the data representing the duet note to be added to the lowest note side of the melody note (MKC).

Figure 2:
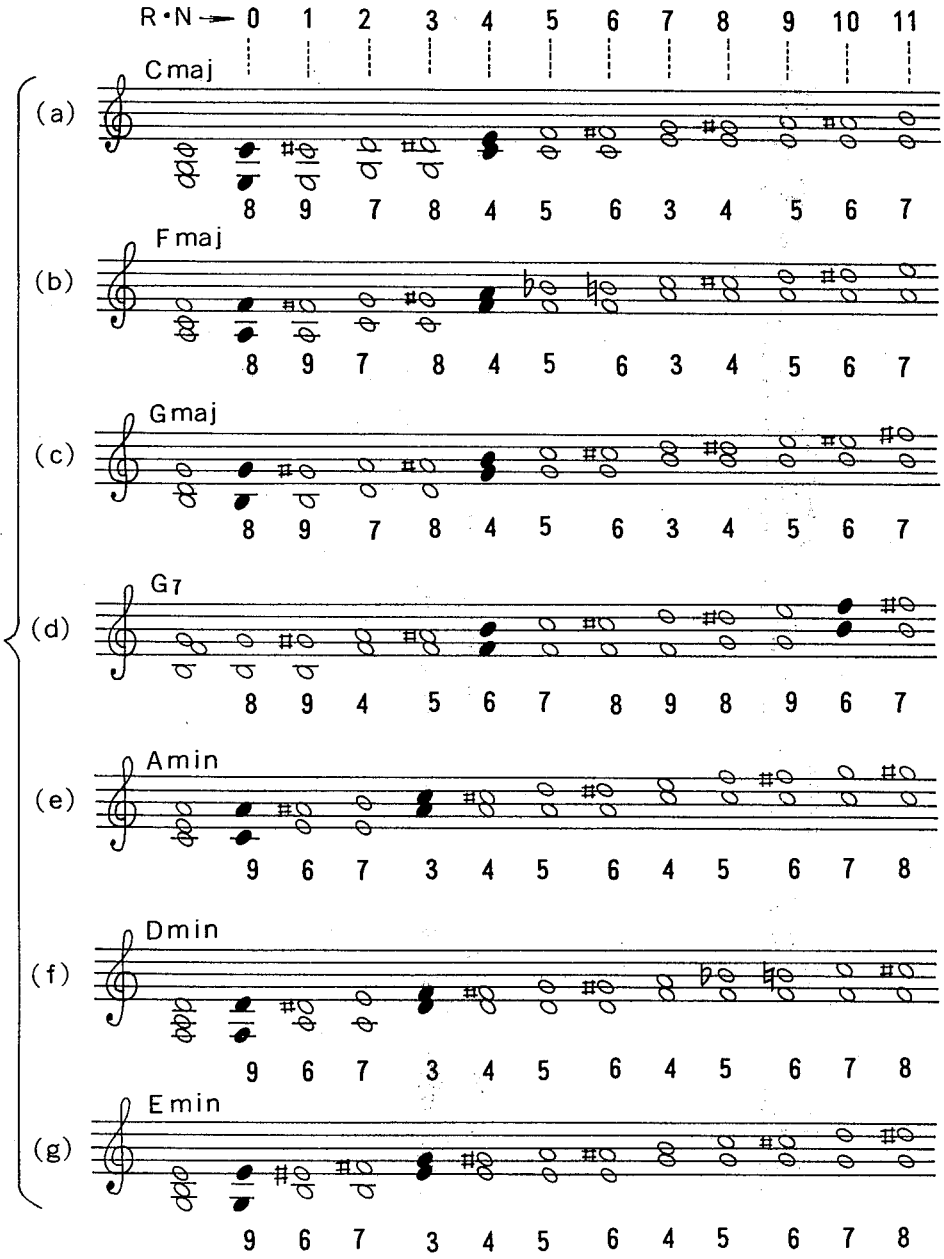
FIGS. 2(*a*) through (*g*) are musical staves for explaining determination of ensemble notes in the embodiment shown in FIG. 1, wherein an example each of a duet note predetermined for each melody note in accordance with the relative scale is shown with respect to each chord.

The duet interval data table shown in Table 1 is made on the basis of the following concept:

Chords frequently used in, e.g., C major key, are C major, F major, G major, G seventh, A minor, D minor and E minor and an example each of preferable duet notes for relative scales of melody notes for these chords is shown in FIGS. 2(*a*) to 2(*g*). In FIGS. 2(*a*-)-2(*g*), three notes depicted below the chord names Cmaj through Emin indicate the chord constituent notes of the respective chords. An upper one of each couple of notes represents a melody note and a lower one a duet note to be added to the melody note. Numerals 0–11 indicated above the melody notes in FIG. 2(*a*) are relative note data R·N, i.e., numerical values representing, in the number of semitones, note intervals of melody notes with respect to the root notes of the chords. Numerals 8, 9, 7, 8, . . . indicated below the duet notes are numerical values representing note intervals between the memody notes and the duet notes in the number of semitones, i.e., the duet interval data ΔD.

In FIG. 2, each duet note is selected by taking into account selection of a duet note from among the chord constituent notes and selection of a duet note by analogous application of a theory of cadence. More specifically, duet notes shown by solid-painted notes are first determined by analogous application of the theory of cadence. Then, other duet notes are selected from the chord constituent chords in such a manner that an interval of the same degree as that between the melody note and the duet note of the solid-painted notes is produced with respect to the melody notes. As described previously, the theory of cadence is applied analogously, all major chords being deemed to be I-chord (tonic triad), all seventh chords to be a $V_7$-chord (dominant seventh chord), the root note of a major chord to be the first degree note (I-note) of the scale and the root note of a seventh chord to be the fifth degree note.

As regards major chords, a melody note which is of the same note as the root note (i.e., relative note data R·N is 0) constitutes the first degree note and the third degree note is a duet note corresponding to this melody note according to the analogously applied theory of cadence. In the case of FIG. 2(*a*), in correspondence to the melody note C which is the first degree note, note E in the lower adjacent octabe which is the third degree note is the duet note. The note interval between the melody note and the duet note in this case is 8 in the number of semitones. The melody note three degrees above the root note (i.e., relative note data R·N is 4) is the third degree note and, by the analogous application of the theory of cadence, the first degree note is the corresponding duet note. In the case of FIG. 2(*a*), in correspondence to the melody note E which is the third degree note, note C which is the first degree note is the duet note. The note interval between the melody note and the duet note in this case is "4" in the number of semitones. As duet notes corresponding to other melody scales (i.e., relative note data R·N is 1, 2, 3, 5, 6, 7, 8, 9, 10, 11), chord constituting notes which are three to six degrees below melody notes are selected. In the case of FIG. 2(*a*), the chord constituting notes are C, E and G and one of them constitutes the duet note.

It will be understood that interval (the number of semitones) between the duet notes and the melody notes in each relative note selected in the above described manner is common to any major chords regardless of the root notes. Accordingly, the table shown in Table 1 has been made by adopting, as duet interval data for major chord, data corresponding to the numbers of semitones "8", "9", "7", . . . between the melody notes and the duet notes for the respective relative notes shown in FIGS. 2(*a*)–2(*c*).

As regards seventh chord, the root note is deemed to be the fifth degree note by assuming the seventh chord to be a chord $V_7$ and a melody note seven degrees above this root note (i.e., relative note data R·N is 10) is selected as the fourth degree note. By the analogous application of the theory of cadence, the seventh degree note, i.e., a note three degrees above the root note, is the corresponding duet note. In the case of FIG. 2(*d*), in correspondence to the melody note F which is the fourth degree note (i.e., relative note data R·N is 10), note B in the next lower octave which is the seventh degree note constitutes the duet note. The note interval between the melody note and the duet note in this case is "6" in the number of semitones. A melody note three degrees above the root note (i.e., relative note R·N is 4) corresponds to the seventh degree note and, by the analogous application of the theory of cadence, the fourth degree note, i.e., a note two degrees below the root note, is selected as the corresponding duet note. In the case of FIG. 2(*d*), in correspondence to the melody note B which is three degrees above the root note, note F which is two degrees below the root note is the duet note. As duet notes corresponding to other melody scales (i.e., relative note data R·N is 0, 1, 2, 3, 5, 6, 7, 8, 9 and 11), chord constituting notes three to six degrees below the melody notes are selected. In the case of FIG. 2(*d*), the chord constituting tones are G, B and F and one of them is selected as the duet note. Note intervals of the duet notes relative to the melody notes in the respective relative notes determined in the above described manner can be applied not only to G seventh chord but to other seventh chords. Accordingly, the table is made as shown in Table 1 by selecting, as the duet interval data for the seventh chord, data corresponding to the number of semitones "8", "9", "4", . . . shown in FIG. 2(*d*).

Minor chords are assumed to be minor chord I and duet notes are determined by analogously applying the theory of cadence. In case of minor, the third degree note is minor third so that a melody note for which the relative note data N·N is "3" constitutes the third degree note. As shown in FIGS. 2(*e*)–2(*g*), the note interval of the duet note for each relative note is common regardless of the root note. Accordingly, the table is made as shown in Table 1 by adopting, as the duet interval data for the minor chord, data corresponding to the number of semitones "9", "6", "7", . . . of the respective duet notes shown in FIGS. 2(*e*) through 2(*g*).

In FIG. 1, the output DKC of the subtractor 22 is supplied to the A input of the selector 23. To the control input SB of the selector 23 is supplied the chord absence signal NCH. If a chord has been detected by the chord detector 15, the chord absence signal NCH is "0" and the key code DKC of a duet note which has been determined in accordance with a signal applied to the A input of the selector 23, i.e., an accompaniment chord is selected. If no chord has been detected, the chord absence signal NCH is "1" and the selector 23 selects the B input and not the A input. This is because the determination of a duet note in accordance with the chord type cannot be made when no chord has been detected. To the B input of the selector 23 is supplied a duet key code DKC′ for chord absent time outputted from a chord absent time duet detector 24.

The lower keyboard note register 25 stores note codes LKNC of key codes for the lower keyboard among key codes KC outputted from the key coder 13. The chord absent time duet detector 24 detects, on the basis of the melody note key code MKC stored in the register 19 and the note code LKNC of the keys played in the lower keyboard (accompaniment notes) stored in the register 25, a note which is of the same note as one of the notes of the keys played in the lower keyboard (accompaniment notes) and lower than the melody note by two or more degrees and thereupon outputs the key code of the detected note as the chord absent time duet note key code DKC′. If the notes of the keys played in the lower keyboard (the depressed keys) do not constitute a chord which is detectable in the chord detector 15, a note name of the duet note is selected from among these lower keyboard notes as the second best means so that a note which is harmonious with the accompaniment notes can be made the duet note and unnaturalness thereby can be prevented.

The duet note key code DKC or DKC′ outputted from the selector 23 is applied to the channel processor 17. The channel processor 17 is a circuit for assigning the key codes KC and the duet note key code DKC (or DKC′) provided by the key coder 13 to either of tone generation channels. A tone generator 26 produces, separately channel by channel, tone signals of tone pitches corresponding to the respective assigned key codes in accordance with the time shared key codes KC and the duet note key codes DKC (DKC′). The tones are generally formed by providing tone colors which differ depending upon the keyboard. Tone colors of the duet note and the melody note may be the same or different. Tone signals produced by the tone generator 26 are supplied to a sound system 27 and are sounded therefrom. As the channel processor 17, the channel processor of the type disclosed in the specification of U.S. Pat. No. 4,192,211 or any other suitable tone assignment circuit may be employed. In the above described manner, the melody tones as designated in the upper keyboard 10, the accompaniment chord tones and automatic bass tones as designated by the lower keyboard 11 and the bass tones as designated by the pedal keyboard 12 are respectively sounded in accordance with the key codes KC provided by the key coder 13 and, simultaneously therewith, duet tones are sounded in accordance with the duet note key codes DKC (or DKC′).

By way of example, in a case where melody notes D4 and F4 are successively played with G seventh chord $G_7$ and a melody note E4 thereafter is played with C major chord Cmaj, duet notes to be added are as follows:

| | |
|---|---|
| Chord | $G_7 \rightarrow$ " $\rightarrow$ Cmaj |
| Melody | $D_4 \rightarrow F_4 \rightarrow E_4$ |
| Duet note | $F_3 \rightarrow B_3 \rightarrow C_4$ |

In the case of G seventh chord, a table for the seventh chord is selected in the duet interval data memory 21 (See Table 1 and FIG. 2(*d*)). In the meanwhile, the root note code RNC indicates note G. When the melody note is D4, the note code MNC therefor is note D and the converter 20 produces, as the relative note data R·N, numeral "7" representing the note interval between the note D and the note G on the lower note side in the number of semitones. In the memory 21, numeral "9" is read from the table for seventh chord as duet interval data ΔD corresponding to the relative note data R·N which is "7". In the subtractor 22, "9" which is the duet interval data ΔD is subtracted from the key code MKC for the melody note D4 in the duodecimal calculation and, as a result, duet note key code DKC representing note F3 which is a note seven semitones lower than the note D4 is outputted. Accordingly, the duet tone F3 is sounded in correspondence to the melody note D4. When the melody note has been changed to F4, the converter 20 outputs numeral "10" representing a note interval between the melody note F and the root note G on the lower note side in the number of semitones as the relative note data R·N. In the memory 21, numeral "6" is read from the table for seventh chord as duet interval data ΔD corresponding to "10" which is the data R·N. In the subtractor 22, "6" which is the data ΔD is subtracted from the key code MKC of the melody note F4 and a duet note key code DKC representing note B3 which is six semitones lower than the note F4 is outputted. Accordingly, the duet tone B3 is sounded in correspondence to the melody note F4.

When the accompaniment chord has been changed to C major, a table for major chord is selected in the duet interval data memory 21 (See Table 1 and FIG. 2(*a*)). The root note code RNC is changed to note C. When the melody note is E4, the converter 20 outputs numeral "4" representing a note interval between the melody note E and the root note C on the lower note side in the number of semitones as the data R·N. In the memory 21, numeral "4" is read from the table for major chord as duet interval data ΔD corresponding to "4" which is the data R·N. In the subtractor 22, "4" which is the data ΔD is subtracted from the key code MKC of the melody note E4 and a duet note key code DKC representing note C4 which is four semitones lower than the note E4 is outputted. Accordingly, the duet tone C4 is sounded in correspondence to the melody note E4.

In the above described example, the chord progression of $G_7 \rightarrow$Cmaj corresponds to $V_7$-chord→I-chord and the melody progression F4→E4 corresponds to fourth degree note→third degree note thereby assuming a cadence form. Progression B3→C4 of the duet note to be added thereto is seventh degree note→first degree note which satisfies the theory of cadence. As described above, mere analogous application of the theory of cadence in accordance with present accompaniment chord and melody notes without confirming the melody progression (prior and subsequent notes played) can achieve duet performance which satisfies the theory of cadence.

In the above described embodiment, a note produced as the ensemble note is one note as a duet note. It is, however, possible to produce a plurality of ensemble notes simultaneously as trio notes and so forth. The key codes (and note codes) in the above embodiment have been described as each consisting of a duodecimal number. The invention, however, is not limited to the use of duodecimal numbers. As is disclosed in the specification of Japanese Preliminary Patent Publication No. 54-98231, the key code KC outputted from the key coder 13 generally consists of a non-continuous numerical arrangement. In that case, a suitable code conversion should be made in the duet note data generator 18 so as not to adversely affect the note interval calculation on the semitone basis.

The keyboard for playing melody tones and that for playing accompaniment tones may be constituted by dividing a single stage keyboard in two key ranges. In this case, the key ranges need not be fixed but may be changed in accordance with the stage of key depression. The chord playing keyboard need not be of a type in which white keys and black keys are provided in a normal twelve-semitone chromatic arrangement but may be of a type in which button switches exclusively for selecting chords are provided.

In the above described embodiment, duet interval data tables corresponding to three chord types (i.e., major, minor, seventh) are provided. The invention, however, is not limited to this but duet interval data tables for more chord types may be provided. Further, the electronic musical instrument shown in FIG. 1 is composed of hardwired logics but it may be composed of a microcomputer system.

What is claimed is:

1. An electronic musical instrument comprising:

a first keyboard section having first keys respectively for playing notes and producing first key identifying signals each representing a depressed key among said first keys;

a second keyboard section having second keys respectively for playing notes and producing second key identifying signals each representing a depressed key among said second keys;

a chord detector connected to said second keyboard section detecting a chord being played on said second keyboard section according to said second key identifying signals and producing a chord identifying signal;

an ensemble note data generator connected to said first keyboard section and said chord detector for producing an ensemble note data signal which represents a note which is apart from the note being played on said first keyboard section by a note interval determined from the detected chord and the played note on said first keyboard section according to a predetermined logic; and a tone generator means for generating tones of notes represented by said first key identifying signal, said second key identifying signal and said ensemble note data signal.

2. An electronic musical instrument as defined in claim 1 wherein said chord detector supplies data representing a root note of the detected chord and data representing a chord type of the detected chord to said ensemble note data generator; and said ensemble note data generator comprises:

conversion means for converting, responsive to output of said first keyboard section and the data supplied from said chord detector, said first key identifying signal to a relative note which is a note degree of a note represented by the first key identifying signal relative to the detected root note;

a memory including tables for respective chord types each having interval data representing a predetermined note interval for each of a plurality of relative notes, one of said tables being selected in response to the chord type data supplied from said chord detector and interval data corresponding to the relative note obtained by said conversion means being read from the selected table; and means for changing, responsive to the output of said first keyboard section and the output of said memory, the first key identifying signal by a note interval corresponding to the interval data to obtain the ensemble note data signal.

3. An electronic musical instrument as defined in claim 2 wherein each interval data in each of said tables is determined, according to the chord type and the value of the relative note, to such a value that one of chord constituting notes in a chord type can be used as the note represented by said ensemble note data signal.

4. An electronic musical instrument as defined in claim 2 wherein said chord detector supplies, if no chord has been detected, a chord absence signal to said ensemble note data generator and, said ensemble note data generator further comprises detection means for detecting notes of key or keys being depressed in said second keyboard section, and means for selecting, responsive to the chord absence signal, one of the notes detected by said detection means as said ensemble note.

* * * * *